US008720887B2

(12) United States Patent
Matsuno et al.

(10) Patent No.: US 8,720,887 B2
(45) Date of Patent: May 13, 2014

(54) CONVEYING MECHANISM AND IMAGE FORMING APPARATUS INCORPORATING CONVEYING MECHANISM

(75) Inventors: Akinori Matsuno, Osaka (JP); Keisuke Mizuguchi, Osaka (JP)

(73) Assignee: Kyocera Mita Corporation (JP)

( * ) Notice: Subject to any disclaimer, the term of this patent is extended or adjusted under 35 U.S.C. 154(b) by 184 days.

(21) Appl. No.: 13/013,871

(22) Filed: Jan. 26, 2011

(65) Prior Publication Data

US 2011/0180987 A1 Jul. 28, 2011

(30) Foreign Application Priority Data

Jan. 27, 2010 (JP) ..... 2010-015166
Mar. 16, 2010 (JP) ..... 2010-059267

(51) Int. Cl.
*B65H 7/02* (2006.01)

(52) U.S. Cl.
USPC ..... 271/258.05; 271/256; 399/113; 399/124

(58) Field of Classification Search
USPC ..... 271/258.05; 399/113, 124
See application file for complete search history.

(56) References Cited

U.S. PATENT DOCUMENTS

2006/0120756 A1* 6/2006 Ahn et al. ..... 399/124
2006/0140669 A1* 6/2006 Sato ..... 399/110

FOREIGN PATENT DOCUMENTS

| | | |
|---|---|---|
| JP | 7-112848 | 5/1995 |
| JP | 9-71356 | 3/1997 |
| JP | 2006-69732 | 3/2006 |
| JP | 2007-47404 | 2/2007 |

* cited by examiner

*Primary Examiner* — Michael McCullough
*Assistant Examiner* — Howard Sanders
(74) *Attorney, Agent, or Firm* — Gerald E. Hespos; Michael J. Porco; Matthew T. Hespos

(57) ABSTRACT

Conveying mechanism includes first conveying element including upstream end on which feeding assembly for supplying sheet; and second conveying element for defining conveying path to guide sheet with the first conveying element, wherein the second conveying element has turning element including pivotal first and second ends, and displacement element coupled to turning element, pivotal first end is held near first conveying element, pivotal second end is coupled to the displacement element, displacement element along first conveying element defines conveying path when turning element is in a first position where turning element extends along first conveying element, and displacement element translates away from first conveying element while forming corner with turning element when turning element turns from first position to move away from first conveying element.

13 Claims, 13 Drawing Sheets

CONVEYING MECHANISM AND IMAGE FORMING APPARATUS INCORPORATING CONVEYING MECHANISM

BACKGROUND OF THE INVENTION

1. Field of the Invention

The present invention relates to a conveying mechanism for conveying sheets, and an image forming apparatus incorporating the conveying mechanism.

2. Description of the Related Art

An image forming apparatus such as a copy machine, a printer, a fax machine or a complex machine with their functions generally conveys a sheet and forms a toner image in the housing. Such an image forming apparatus typically comprising a removal mechanism configured to remove sheets jammed in the housing.

A known removal mechanism includes a sheet feeder and a conveying portion, which are connected with each other by a link mechanism, and allows them to be integrally pulled out from the housing. A user may pull out the sheet feeder and the conveying portion from the housing to remove sheets jammed in the housing.

Since the sheet feeder and the conveying portion of the aforementioned removal mechanism are integrally pulled out from the housing, the user may more efficiently remove the sheets jammed in the housing. The link mechanism integrating the sheet feeder and the conveying portion, however, results in increase in size of the entire image forming apparatus. Moreover, appropriate settings for feeding a sheet is likely to change because the sheet feeder is unnecessarily moved, which results in a failure of the sheet feeding process.

SUMMARY OF THE INVENTION

An object of the present invention is to provide an image forming apparatus which allows efficient removal of a sheet without unnecessarily moving a sheet feeding mechanism configured to feed sheets.

A conveying mechanism for conveying a sheet according to one aspect of the present invention includes: a first conveying element including an upstream end on which a feeding assembly for feeding the sheet is formed; a second conveying element configured to confront the first conveying element, wherein the second conveying element at least partially defining a conveying path for guiding the sheet in cooperation with the first conveying element has a turning element including a first end and a second end which are aligned along a sheet feeding direction, and a displacement element coupled to the turning element, the pivotal first end is held near the first conveying element, the pivotal second end is coupled to the displacement element, the displacement element along the first conveying element defines the conveying path when the turning element is located in a first position where the turning element extends along the first conveying element, and the displacement element translates away from the first conveying element to form a corner with the turning element when the turning element turns from the first position to move away from the first conveying element.

An image forming apparatus having an image forming portion for forming an image on a sheet according to another aspect of the present invention includes: a housing configured to accommodate the image forming portion; and a conveying mechanism configured to at least partially define a conveying path for guiding the sheet to the image forming portion, wherein the conveying mechanism has a first conveying element including an upstream end on which a feeding assembly for feeding the sheet is formed, and a second conveying element configured to confront the first conveying element, the second conveying element configured to define the conveying path in cooperation with the first conveying element has a turning element including a first end and a second end which are aligned along a sheet feeding direction, and a displacement element coupled to the turning element, the pivotal first end is held near the first conveying element, the pivotal second end is coupled to the displacement element, the displacement element along the first conveying element defines the conveying path when the turning element is located in a first position where the turning element extends along the first conveying element, and the displacement element translates away from the first conveying element while forming a corner with the turning element, when the turning element turns from the first position to move away from the first conveying element.

DETAILED DESCRIPTION OF THE PREFERRED EMBODIMENTS

One embodiment of an image forming apparatus is described hereinafter with reference to the accompanying drawings. It should be noted that directional terms such as "upper," "lower," "left" and "right" hereinafter simply aim to clarify the descriptions without limiting a principle of the image forming apparatus. Also, a term "sheet" in the following descriptions means a copy sheet, coated sheet, OHP sheet, cardboard, postcard, tracing paper and other sheet materials subjected to an image forming process. A term "leading edge of a sheet" means a leading edge of the sheet in a sheet conveying direction. Terms "upstream", "downstream" and other similar terms hereinafter mean concepts of "upstream," "downstream" and the like in terms of the sheet conveying direction.

Figure 1:
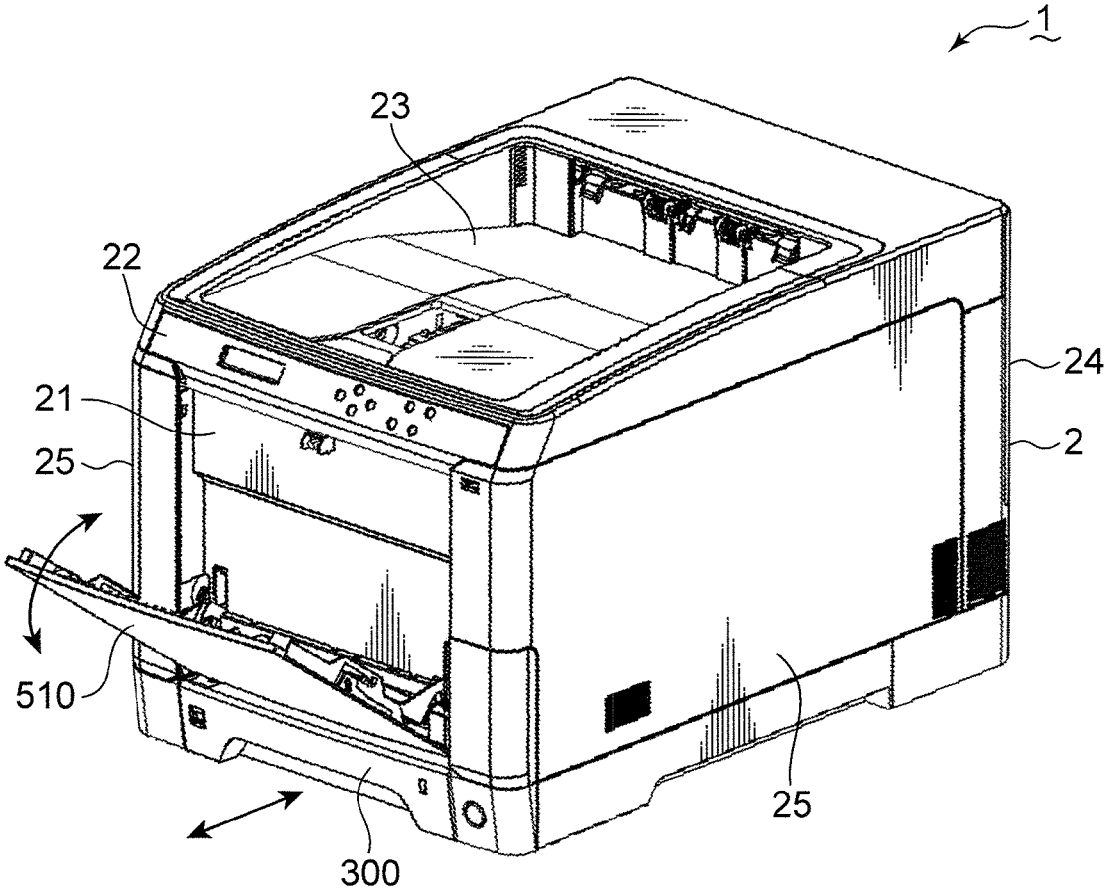
FIG. 1 is a perspective view of an image forming apparatus according to one embodiment.

FIG. 1 is a perspective view showing an appearance of the image forming apparatus according to one embodiment. It should be noted that the image forming apparatus shown in FIG. 1 is a printer. The image forming apparatus may be any other apparatus configured to form an image on a sheet, such as a copy machine, a fax machine or a complex machine with their functions.

An image forming apparatus 1 comprises a substantially rectangular parallelepiped housing 2, a tray 510 protruding from a front side of the housing 2 and a cassette 300 disposed below the tray 510. The housing 2 accommodates various equipments necessary to form an image on a sheet (e.g., various elements used in an image forming portion described hereinafter). The tray 510 attached to the housing 2 turns around a lower edge of the tray 510. The tray 510 shown in FIG. 1 is located in a protruding position so as to protrude from the housing 2. A user may place a sheet on the tray 510 located in the protruding position. A feeding assembly, which is described hereinafter, feeds the sheet on the tray 510 toward the image forming portion configured to form an image on the sheet. When the user turns the tray 510 closer to the housing 2 from the protruding position, the tray 510 becomes accommodated in a concave area 21 formed on the housing 2. The cassette 300 is configured to be inserted into and drawn out from the housing 2. The user may draw out the cassette 300 from the housing 2 toward the front side to place sheets in the cassette 300. After placing desired sheets in the cassette 300, the user may insert the cassette 300 into the housing 2. In the following descriptions, the sheet on the tray 510 is exemplified as a first sheet, and the sheet accommodated in the cassette 300 is exemplified as a second sheet. The image forming apparatus 1 may selectively convey the first sheet and the second sheet to the image forming portion to form a toner image.

An operation panel 22 is disposed above the tray 510. The user may operate the operation panel 22 to perform a desired operation on the image forming apparatus 1. The operation panel 22 may includes a button for adjusting, for example, density of the toner image. The image forming apparatus 1 forms a toner image on a sheet in accordance with an input from the user onto the operation panel 22, as well as an image signal (a signal with information on an image to be printed) sent from an external device (e.g., a personal computer).

After the image forming portion forms a toner image on a sheet fed from the tray 510 or the cassette 300, the sheet is discharged onto a discharge tray 23 formed on an upper surface of the housing 2. The sheet subjected to the image forming process is stacked in a space in the form of a substantially triangular pole, which is formed on an upper surface of the discharge tray 23.

Figure 2:
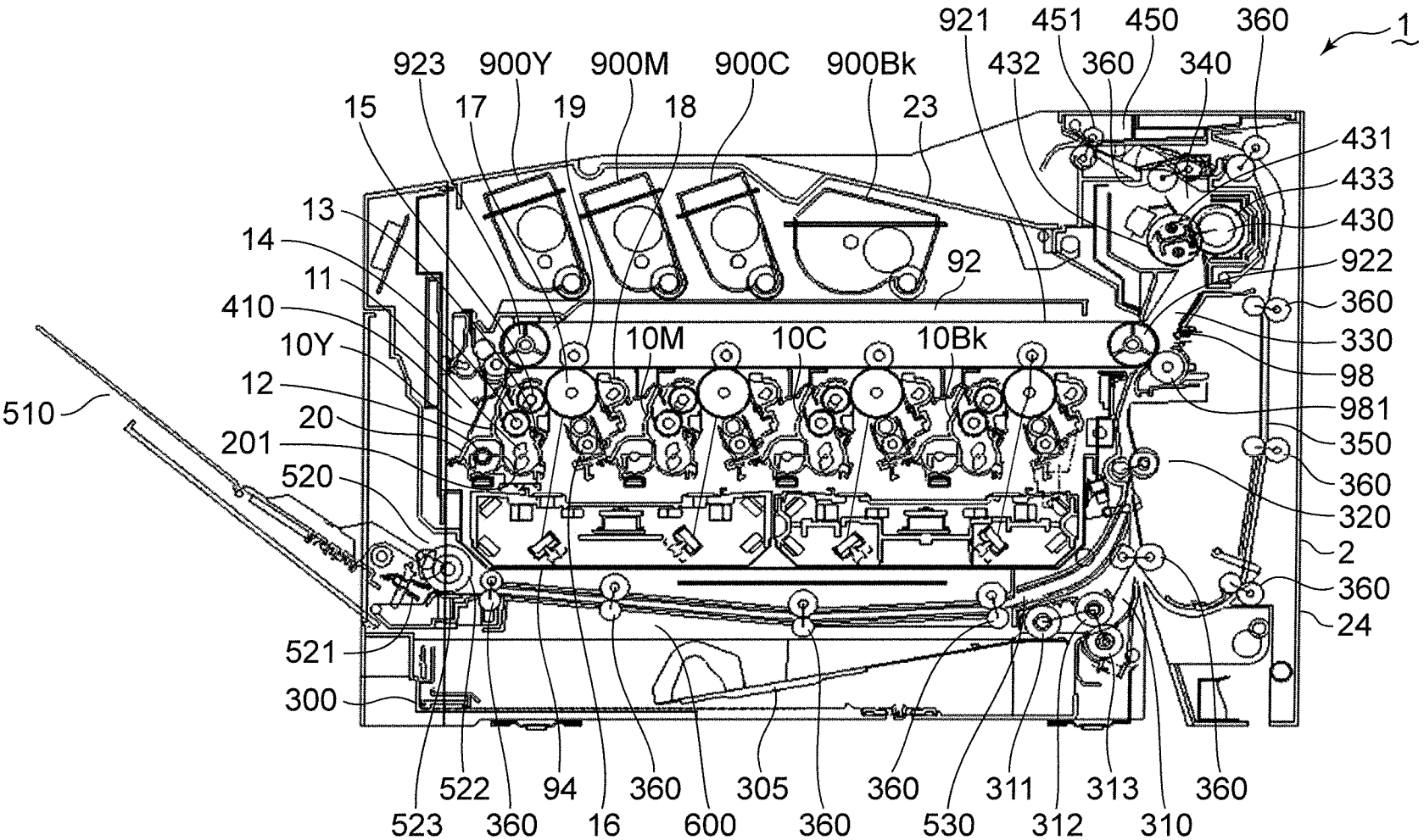
FIG. 2 is a diagram schematically showing an internal structure of the image forming apparatus shown in FIG. 1.

FIG. 2 schematically shows an internal structure of the image forming apparatus 1. The image forming apparatus 1 is further described with reference to FIGS. 1 and 2.

As described above, a sheet is conveyed from the tray 510 or the cassette 300. Subsequently, the sheet is guided by a conveying path formed in the housing 2 and sent to the image forming portion 410. The image forming portion 410 forms the toner image on the sheet. The sheet is then conveyed to a fixing portion 430. The fixing portion 430 fixes the toner image onto the sheet. Thereafter, the sheet is discharged onto the discharge tray 23 through a discharge portion 450.

The conveying path includes a first feed path 530 extending toward a back wall 24 of the housing 2. A feeding assembly 520 configured to pull the first sheet into the housing and feed it to the image forming portion 410 is disposed at an upstream end of the first feed path 530. The conveying path further includes a second feed path 310 extending upward from a downstream end of the cassette 300 (the right end in FIG. 2) located below the first feed path 530. The first feed path 530 and the second feed path 310 join together at an upstream side of a resist roller pair 320 configured to send a sheet to the image forming portion 410 in synchronization with the image forming process performed by the image forming portion 410. A substantially linear section in the first feed path 530 above the cassette 300 is formed by a conveying mechanism 600, which is described hereinafter.

The conveying path further includes a main conveying path 330 for guiding a sheet from the resist roller pair 320 to the fixing portion 430, and a discharge conveying path 340 for guiding the sheet from the fixing portion 430 to the discharge portion 450. The image forming portion 410 forms a toner image on a sheet moving along the main conveying path 330. The fixing portion 430 then fixes the toner image onto the sheet. If a user performs one-side printing using the image forming apparatus 1, the discharge portion 450 discharges the sheet, which is sent from the fixing portion 430 to the discharge conveying path 340, to the outside of the housing 2. The discharged sheet is stacked on the discharge tray 23.

If the user performs both side printing using the image forming apparatus 1, the discharge portion 450 carries out a switchback operation so that a certain length of the sheet sent from the fixing portion 430 to the discharge conveying path 340 is further sent outside the housing 2 and then pulled back into the housing 2. The conveying path further includes a return conveying path 350 for guiding the sheet pulled back by the discharge portion 450. The return conveying path 350 extends toward the back wall 24 of the housing 2 from the discharge portion 450 and then extends downward. Thereafter, the return conveying path 350 extends toward the second feed path 310 and joins together with the second feed path 310.

A conveying roller pair 360 configured to convey a sheet guided by the first feed path 530, the second feed path 310, the main conveying path 330, the discharge conveying path 340 and the return conveying path 350 is disposed in proper places of these conveying paths.

As described above, the feeding assembly 520 sends the first sheet put on the tray 510 to the first feed path 530 formed by the conveying mechanism 600. The feeding assembly 520 comprises a lift plate 521 configured to lift up a leading edge of the first sheet on the tray 510 which is inclined downward towards the housing 2, a feed roller 522 configured to come into contact with the leading edge of the first sheet lifted up by the lift plate 521, and a separating pad 523 disposed below the feed roller 522. When the feed roller 522 rotates, the first sheet passes between the feed roller 522 and the separating pad 523, and is then sent into the first feed path 530. The separating pad 523 applies frictional force to the first sheet passing between the feed roller 522 and the separating pad 523. Therefore, when the feed roller 522 sends several first sheets to the first feed path 530, the separating pad 523 applies frictional force acting in a direction opposite to the conveying direction, to the first sheets other than the top first sheet (the first sheet which is in direct contact with the feed roller 522), to prevent conveyance of these redundant first sheets into the first feed path 530. Consequently the first sheets are sent into the first feed path 530 one by one.

The cassette 300, which is used as another sheet feeding source, includes a lift plate 305 configured to support the second sheet. The lift plate 305 inclines so as to lift up a leading edge of the second sheet in the cassette 300. A pickup roller 311 is disposed above a downstream end of the lift plate 305. The pickup roller 311 comes into contact with the leading edge of the second sheet lifted up by the lift plate 305. Consequently the second sheet is sent from the cassette 300 to the downstream as the pickup roller 311 rotates.

A feed roller 312 and a separating roller 313 below the feed roller 312 are disposed at a downstream position of the pickup roller 311. The pickup roller 311 sends the second sheet between the feed roller 312 and the separating roller 313. The feed roller 312 rotates to send the second sheet further downstream. The separating roller 313, on the other hand, rotates in a direction for returning the second sheet back to the cassette 300. Therefore, when the pickup roller 311 sends several second sheets, the separating roller 313 pulls the second sheets other than the top second sheet (the second sheet which is in direct contact with the feed roller 312) back to the cassette 300. Consequently the second sheets are sent to the second feeding path 310 one by one.

The sheets conveyed to the second feed path 310 are sent toward the resist roller pair 320 by the conveying roller pair 360 provided in the second feed path 310 with which the aforementioned return conveying path 350 joins together at an upstream position of the conveying roller pair 360 in the second feed path 310. Therefore, the conveying roller pair 360 in the second feed path 310 similarly sends the sheets fed to the second feed path 310 via the return conveying path 350, to the resist roller pair 320 as well. The first feed path 530 and the second feed path 310 joins together at the upstream position of the resist roller pair 320. Thus, the resist roller pair 320 feeds the sheets conveyed through the first feed path 530 or the second feed path 310, to the image forming portion 410.

The image forming portion 410 comprises a yellow (Y) toner container 900Y, magenta (M) toner container 900M, cyan (C) toner container 900C, and black (Bk) toner container 900Bk. Developing devices 10Y, 10M, 10C and 10Bk corresponding to the YMCBk are disposed below these containers, respectively. The image forming portion 410 uses the toner contained in these toner containers 900Y, 900M, 900C and 900Bk to form an image on a sheet.

The image forming portion 410 comprises photosensitive drums 17 (photoreceptors on which latent images are formed by electrophotography) configured to bear toner images thereon. Photosensitive drums using amorphous silicon (a-Si) based materials may be used as the photosensitive drums 17. The photosensitive drums 17 are supplied with the yellow, magenta, cyan and black toner from the toner containers 900Y, 900M, 900C and 900Bk, respectively.

A charger 16, the developing device 10 (10Y, 10M, 10C or 10Bk), a transfer roller 19 and a cleaning device 18 are disposed on a circumference of the photosensitive drum 17. The charger 16 uniformly charges the surface of the photosensitive drum 17. An exposure unit 94 exposes the surfaces of the charged photosensitive drums 17 to light to form electrostatic latent images on the photosensitive drums 17, respectively. The exposure unit 94 radiates laser beams based on, for example, image signals (signal with image information) from the external device. The developing devices 10Y, 10M, 10C and 10Bk use the toner supplied by the toner containers 900Y, 900M, 900C and 900Bk, to develop (visualize) the electrostatic latent images formed on the photosensitive drums 17, respectively. The transfer roller 19 and the photosensitive drum 17 sandwich an intermediate transfer belt 921 to form a nip. The transfer roller 19 primarily transfers the toner image formed on the photosensitive drum 17 onto the intermediate transfer belt 921. The cleaning device 18 cleans the circumferential surface of the photosensitive drum 17 after the transfer of the toner image.

The developing devices 10Y, 10M, 10C and 10Bk comprise developing housings 20, respectively. The developing housing 20 may store two-component developer with magnetic carrier and toner. Stirring rollers 11 and 12 are disposed near a bottom of the developing housing 20. The stirring rollers 11 and 12 extending parallel to each other rotate inside the developing housing 20.

A developer circulation path is formed on an inner bottom surface of the developing housing 20. The stirring rollers 11 and 12 are disposed in the circulation path. The developing housing 20 includes a partition 201 disposed between the stirring rollers 11 and 12. The partition 201 stands upright from the bottom of the developing housing 20 to partially partition the circulation path. The circulation path surrounds the partition 201. The two-component developer is stirred by the stirring rollers 11 and 12 and conveyed along the circulation path.

The toner is charged while the stirring rollers 11 and 12 stir and circulate the two-component developer in the developing housing 20. The two-component developer on the stirring roller 11 is attracted by a magnetic roller 14 above the stirring roller 11. The attracted two-component developer forms a magnetic brush (not shown) on the magnetic roller 14. A doctor blade regulates thickness of the magnetic brush. A toner layer is formed on a developing roller 15 by potential difference between the magnetic roller 14 and the developing roller 15. The electrostatic latent image on the photosensitive drum 17 is developed by the toner layer.

The exposure unit 94 comprises various optical equipments such as a light source, a polygon mirror, a reflective mirror and a polarizing mirror. The exposure unit 94 irradiates the circumferential surface of the photosensitive drum 17 provided in the image forming portion 410, with the light based on the image signals to form the electrostatic latent image.

An intermediate transfer unit 92 includes the intermediate transfer belt 921, a driving roller 922 and an idler 923. The toner images formed by the photosensitive drums 17 are superimposed (primarily transferred) to the intermediate transfer belt 921. The superimposed toner images are secondarily transferred by a secondary transfer part 98 to the sheet fed from the cassette 300 or the tray 510. The driving roller 922 and the idler 923 to run the intermediate transfer belt 921 are rotatably supported by the housing 2.

The sheet conveyed from the resist roller pair 320 is sent between the intermediate transfer belt 921 and a transfer roller 981 which configure the secondary transfer part 98. Subsequently, the sheet bearing the toner image transferred by the secondary transfer part 98 is sent to the fixing portion 430.

The fixing portion 430 comprises a heating roller 432 including a built-in heater 431, and a pressure roller 433 compressed to the heating roller 432. The sheet sent from the secondary transfer part 98 is delivered between the heating roller 432 and the pressure roller 433. The toner on the sheet is melted by heat energy from the heating roller 432 and receives pressure from the pressure roller 433. Consequently the toner image is fixed onto the sheet. The fixing portion 430 sends the sheet to the discharge portion 450 through the discharge conveying path 340 after fixing the toner images onto the sheet.

The discharge portion 450 comprises a discharge roller pair 451. The discharge roller pair 451 bi-directionally rotates to accomplish the aforementioned switchback operation.

Figure 3:
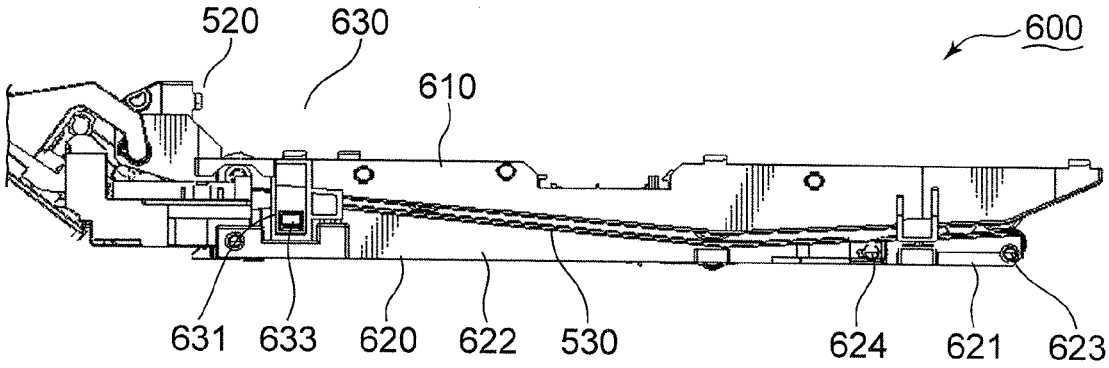
FIG. 3 is a side view showing a conveying mechanism of the image forming apparatus shown in FIG. 2.
Figure 4:
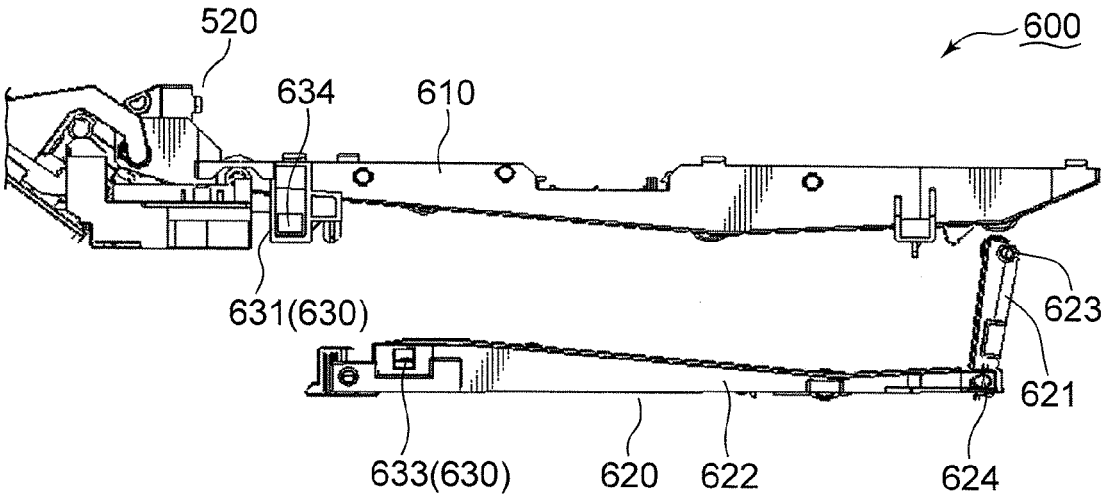
FIG. 4 is a side view showing the conveying mechanism of the image forming apparatus shown in FIG. 2.

FIG. 3 is a side view showing the conveying mechanism 600 which forms the first feed path 530. FIG. 4 is a side view showing the conveying mechanism 600 in which the first feed path 530 is opened up. The conveying mechanism 600 is described with reference to FIGS. 2 to 4.

The conveying mechanism 600 comprises a first conveying element 610 and a second conveying element 620 disposed below the first conveying element 610. An upper surface of the second conveying element 620 along a lower surface of the first conveying element 610 defines the first feed path 530. In the following description, the position of the second conveying element 620 where the upper surface of the second conveying element 620 extends along the lower surface of the first conveying element 610 is exemplified as a first position.

The feeding assembly 520 described in the context of FIG. 2 is formed at an upstream end of the first conveying element 610. As described above, the feeding assembly 520 feeds a sheet to the first feed path 530 formed between the first conveying element 610 and the second conveying element 620.

The second conveying element 620 confronting the first conveying element 610 forms the first feed path 530 in cooperation with the first conveying element 610, as described above. The second conveying element 620 comprises a turning element 621 and a displacement element 622 disposed on an upstream side with respect to the turning element 621.

The turning element 621 is attached to a support bracket extending downward from an inner wall of the housing 2 or from a side surface of the first conveying element 610. The turning element 621 turns around its downstream end. In the following description, the downstream end of the turning element 621 is exemplified as a first end 623. An upstream end of the turning element 621 is exemplified as a second end 624. The turning element 621 may turn around the first end 623 in a direction in which the second end 624 moves away from the first conveying element 610.

A pivotal downstream end of the displacement element 622 is connected to the second end 624. When the turning element 621 is in the first position, the displacement element 622 is disposed in a position where the displacement element 622 extends along and exists near the first conveying element 610 to form the first feed path 530. The displacement element 622 translates away from the first conveying element 610 in synchronization with the displacement of the second end 624 when the turning element 621 turns downward from the first position and the second end 624 moves away from the first conveying element 610. The separation of the displacement element 622 from the first conveying element 610 is a substantially parallel shift. Therefore, while the displacement element 622 translates away from the first conveying element 610, the displacement element 622 gradually forms a corner with the turning element 621.

Figure 5:
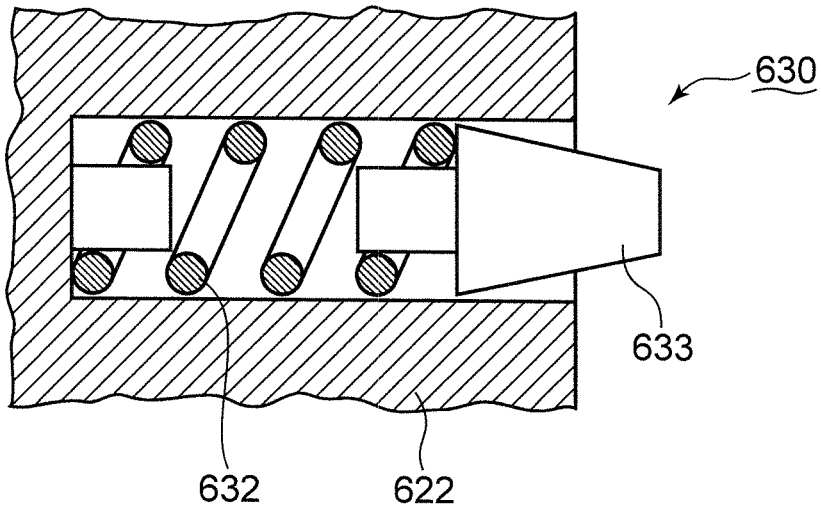
FIG. 5 is a cross-sectional view schematically showing a positioning mechanism of the conveying mechanism shown in FIGS. 3 and 4.

FIG. 5 is a cross-sectional view schematically showing a positioning mechanism configured to position the second conveying element 620 in the first position. The positioning mechanism is described with reference to FIGS. 3 to 5.

The conveying mechanism 600 comprises a positioning mechanism 630 configured to position the second conveying element 620 in the first position. The positioning mechanism 630 comprises a substantially rectangular frame 631 attached to a side surface of the first conveying element 610, a biasing member 632 buried in the displacement element 622, and an engaging piece 633 attached to a tip of the biasing member 632. An engaging hole 634 is formed in the frame 631. In the present embodiment, a coil spring is used as the biasing member 632. Alternatively, any member configured to causes the engaging piece 633 to retract into and protrude from the side surface of the displacement element 622 may be used as the biasing member 632.

When the turning element 621 is in the first position, the displacement element 622 is disposed in the position where the displacement element 622 extends along the first conveying element 610, as described above. At this moment, the engaging piece 633 of the positioning mechanism 630 is inserted into the engaging hole 634. Consequently the displacement element 622 and the turning element 621 are positioned with respect to the first conveying element 610 and fixed at the first position. Thus the displacement element 622 and the turning element 621 do not unnecessarily move away from the first conveying element 610.

Figure 6A:
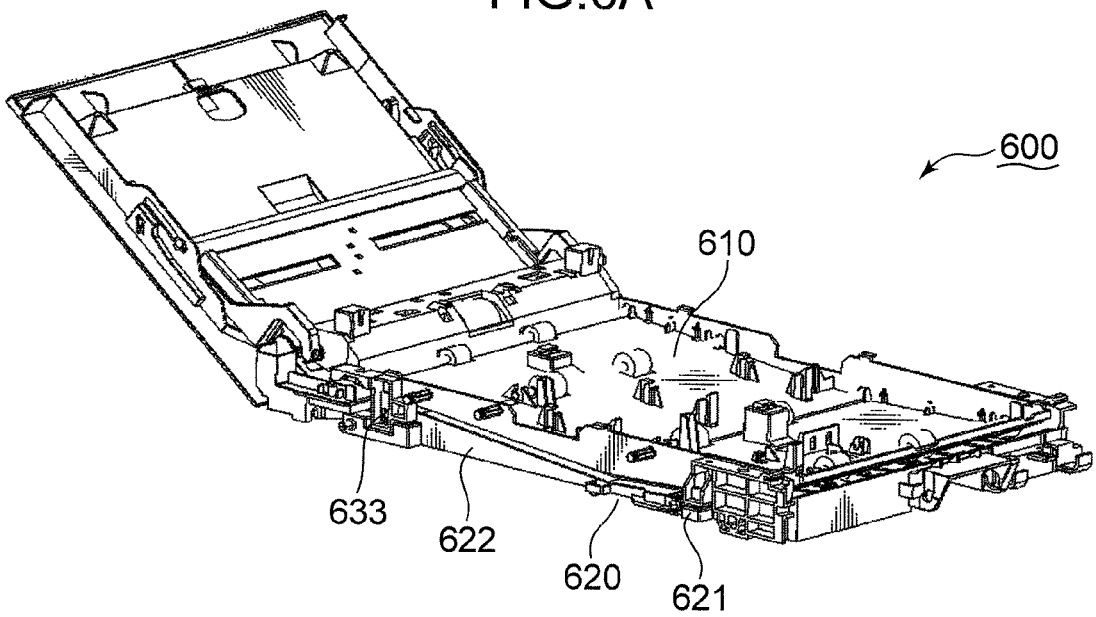
FIG. 6A is a perspective view of the conveying mechanism shown in FIGS. 3 and 4.
Figure 6B:
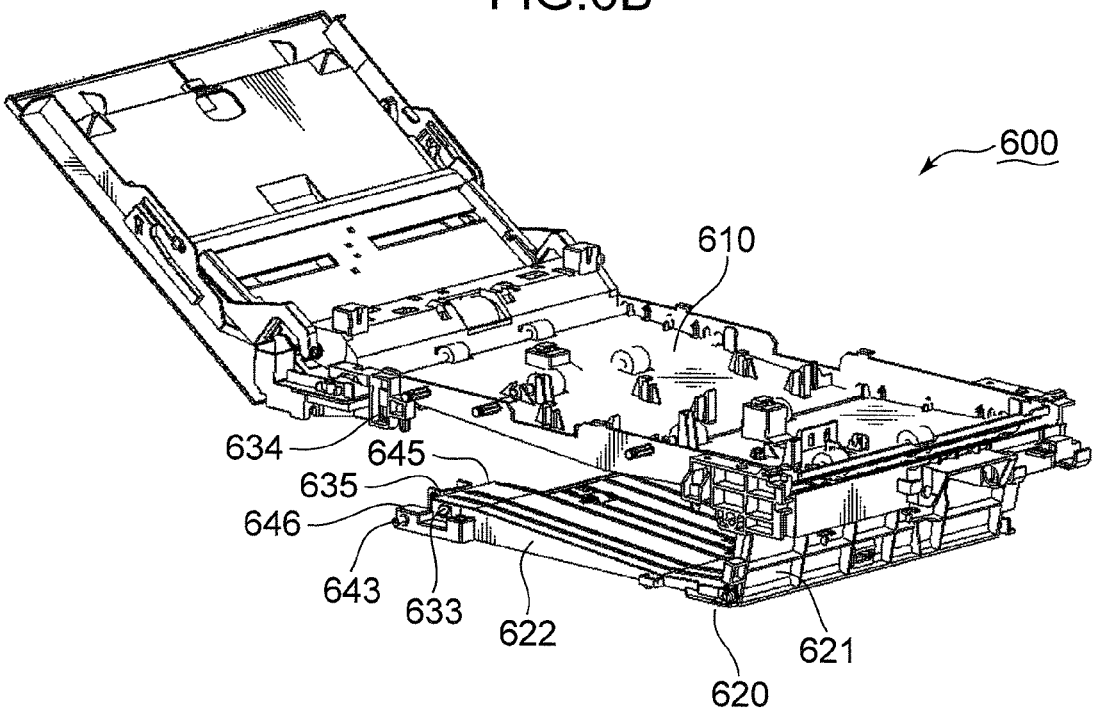
FIG. 6B is a perspective view of the conveying mechanism shown in FIGS. 3 and 4.

FIGS. 6A and 6B are perspective views of the conveying mechanism 600. FIG. 6A shows the conveying mechanism 600 with the second conveying element 620 positioned in the first position. FIG. 6B shows the conveying mechanism 600 with the second conveying element 620 moved downward from the first position. An opening operation of the conveying mechanism 600 is described with reference to FIGS. 3 to 6B.

When a user applies downward force to a handle 635 formed at an upstream edge of the displacement element 622, the engaging piece 633 becomes buried into the displacement element 622 so that the engaging piece 633 is disengaged from the engaging hole 634. Thus the user may more easily form a space between the first conveying element 610 and the second conveying element 620. Therefore, the user may easily remove jammed sheets in the conveying mechanism 600.

Figure 7:
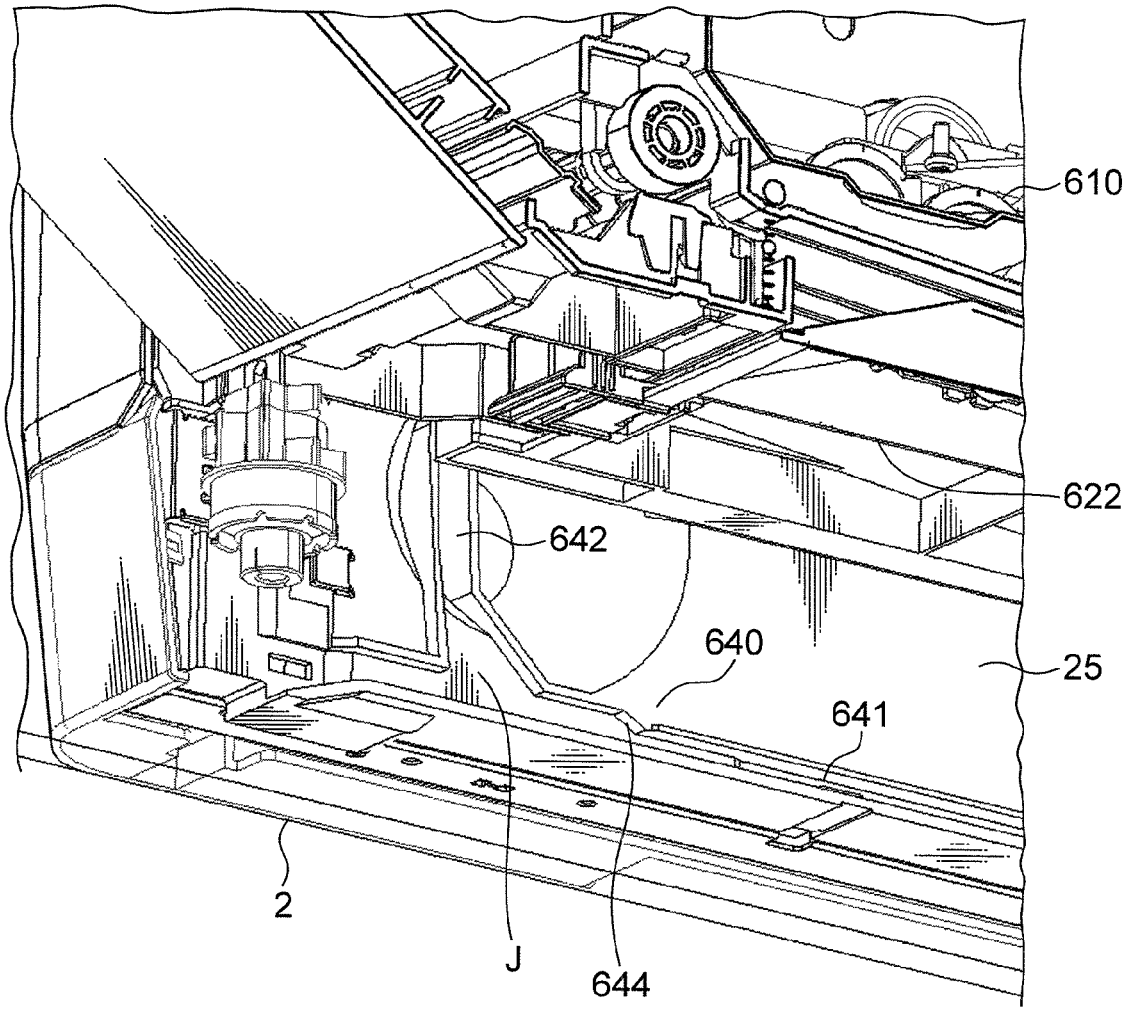
FIG. 7 is a perspective view schematically showing a structure configured to guide a displacement element of the conveying mechanism shown in FIGS. 6A and 6B.

FIG. 7 is a perspective view showing an internal structure of the housing 2 which forms an accommodating space for accommodating the cassette 300 shown in FIG. 1. The structure configured to guiding displacement of the displacement element 622 is described with reference to FIG. 1 and FIGS. 6A to 7.

Rails 640 are formed in inner surfaces of left and right side walls 25 of the housing 2. The rail 640 includes a first rail 641 extending along a lower edge of the housing 2, and a second rail 642 joining together with the first rail 641 near an upstream end of the first rail 641 (an end near an opening of the accommodating space to accommodate the cassette 300). The second rail 642 vertically extends. The first rail 641 is used for guiding insertion and drawing out of the cassette 300 into and from the housing 2.

As shown in FIGS. 6A and 6B, a substantially cylindrical guide piece 643 protrudes from the side surface of the displacement element 622. The guide piece 643 located at an upstream end of the displacement element 622 engages with the second rail 642. As described in the context of FIGS. 6A and 6B, when a user applies force to the handle 635 to move the displacement element 622 downward (to separate the displacement element 622 from the first conveying element 610), the displacement element 622 is guided by the engagement between the second rail 642 and the guide piece 643. The width of the second rail 642 gradually increases near a lower end of the second rail 642. The increase in the width of the second rail 642 corresponds to downstream displacement of the guide piece 643, which is accompanied by the turning of the turning element 621.

Figure 8:
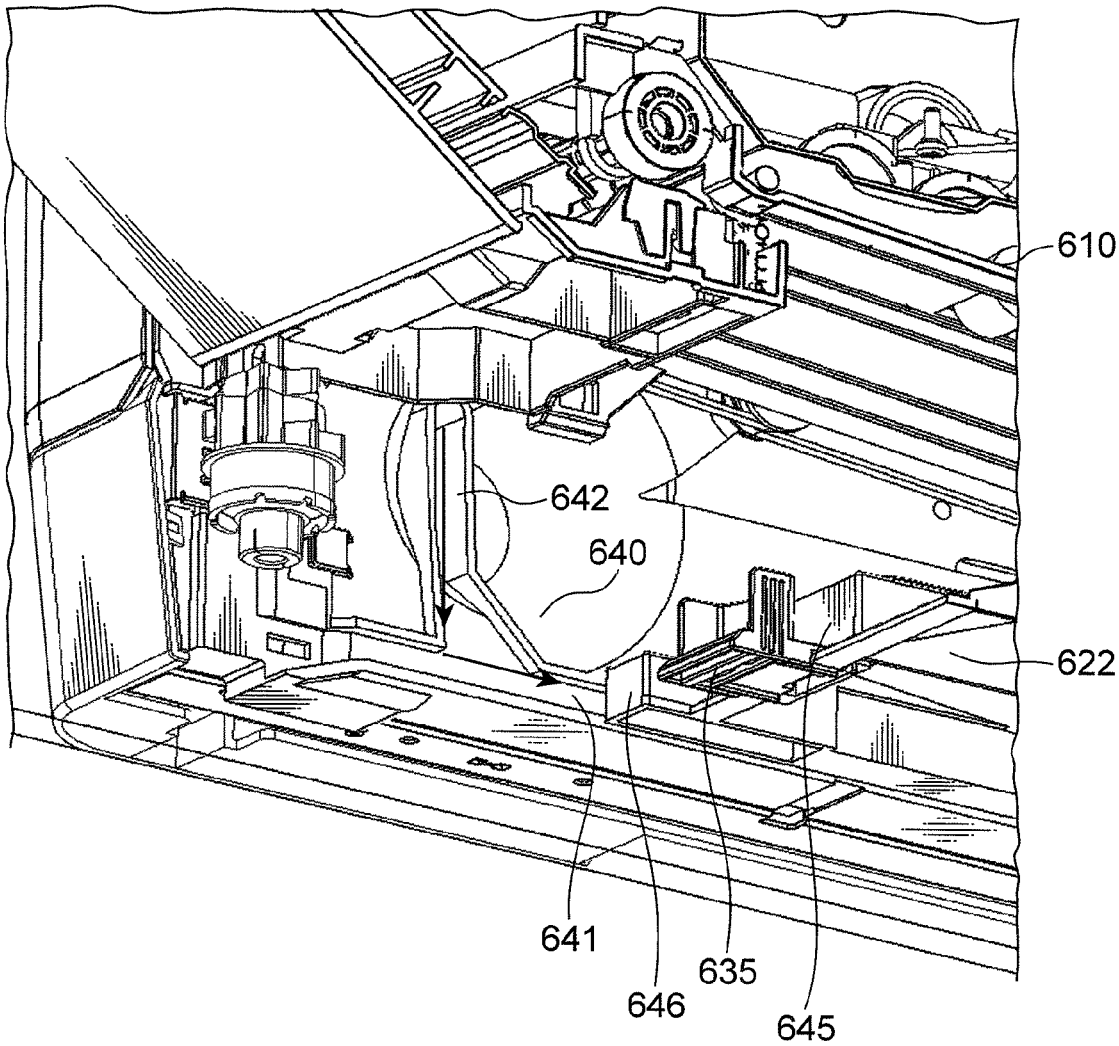
FIG. 8 is a perspective view schematically showing the structure configured to guide the displacement element of the conveying mechanism shown in FIGS. 6A and 6B.

FIG. 8 is a perspective view showing the internal structure of the housing 2 where the displacement element 622 is separated from the first conveying element 610. The displacement of the displacement element 622 is further described with reference to FIG. 1 and FIGS. 6A to 8.

As described above, the second rail 642 joins together with the first rail 641. Therefore the guide piece 643 after movement along the second rail 642 and arrival at the lower end of the second rail 642 is transferred to the first rail 641 and then moves along the first rail 641. Since the first rail 641 guides the guide piece 643 in addition to the cassette 300, an additional element for guiding the guide piece 643 is not required, which results in the downsized image forming apparatus 1.

Thus a user after ejecting the cassette 300 from the housing 2 may effectively utilize the space to accommodate the cassette 300 in order to separate the displacement element 622 from the first conveying element 610 and form a space between the first conveying element 610 and the second conveying element 620. Consequently the user may easily remove jammed sheets between the first conveying element 610 and the second conveying element 620. In the present embodiment, the turning element 621 may contribute to creating a larger space extending to a downstream end of the conveying mechanism 600, as shown in FIG. 6B, which results in efficient removal of the jammed sheets. In the present embodiment, the user may remove the sheets from the front side of the housing 2. The left and right side walls 25 of the housing 2 may open. In this case, the user may remove sheets from the lateral side of the conveying mechanism 600.

(A Structure for Avoiding Failures Resulting from Operation Mistakes of a User)

A user may potentially insert the cassette 300 into the housing 2 again, while the displacement element 622 is separated from the first conveying element 610. The following describes a structure configured to prevent such an erroneous operation from applying excessive load to the connection between the displacement element 622 and the turning element 621 and/or the connection between the turning element 621 and the housing 2.

Figure 9:
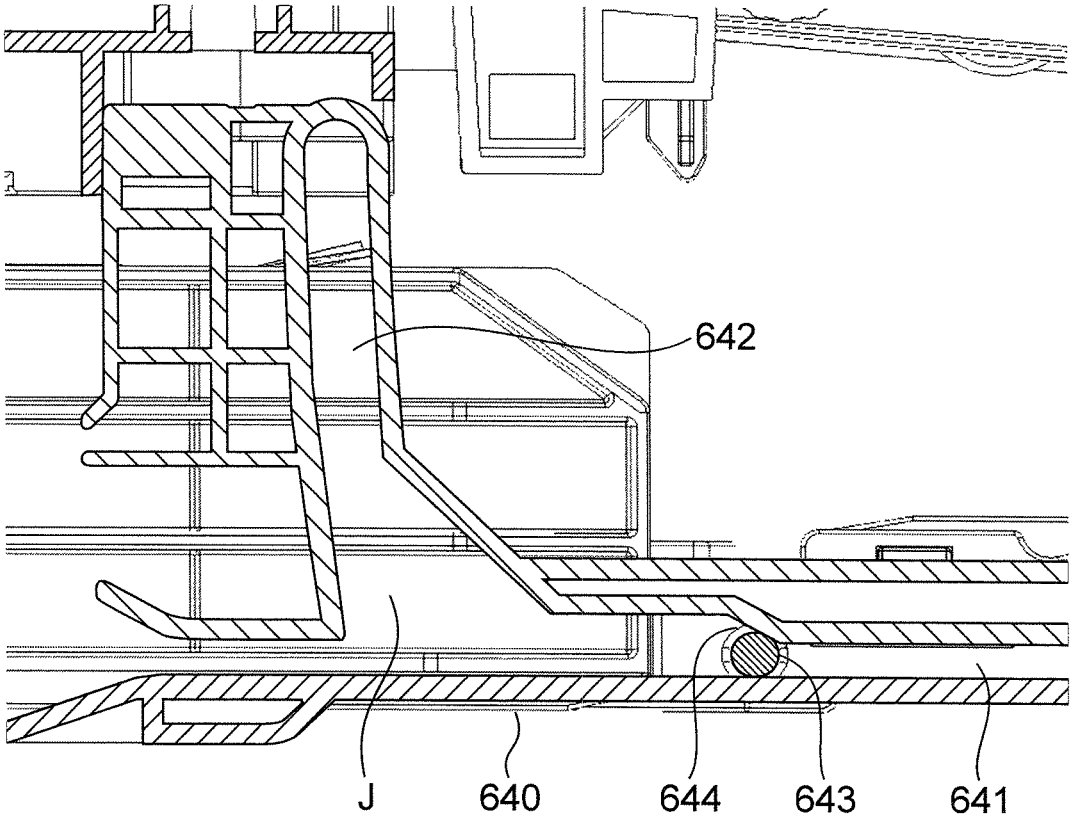
FIG. 9 is a cross-sectional view showing a structure of a rail for avoiding failures resulting from operation mistakes of a user.

FIG. 9 shows a structure of the rail 640 configured to avoid failures resulting from operation mistakes of a user. The structure configured to avoid the failures resulting from the operation mistakes of the user is described with reference to FIG. 2, FIGS. 6A to 7, and FIG. 9.

A portion of the first rail 641 extending from a junction J between the first rail 641 and the second rail 642 towards the back wall 24 of the housing 2 includes a gradually narrowing neck 644. The neck 644 makes the first rail 641 narrower than a diameter of the cylindrical guide piece 643 of the displacement element 622. Therefore, the guide piece 643 moving along the first rail 641 from the junction J between the first rail 641 and the second rail 642 is stopped by the neck 644. Thus, even when the user inserts the cassette 300 into the housing 2 again while the displacement part 622 is separated from the first conveying element 610, the displacement element 622 is prevented from moving and the turning element 621 is also prevented from turning. Consequently, excessive load is less likely to be applied to the connection between the displacement element 622 and the turning element 621 and/or the connection between the turning element 621 and the housing 2.

Figure 10:
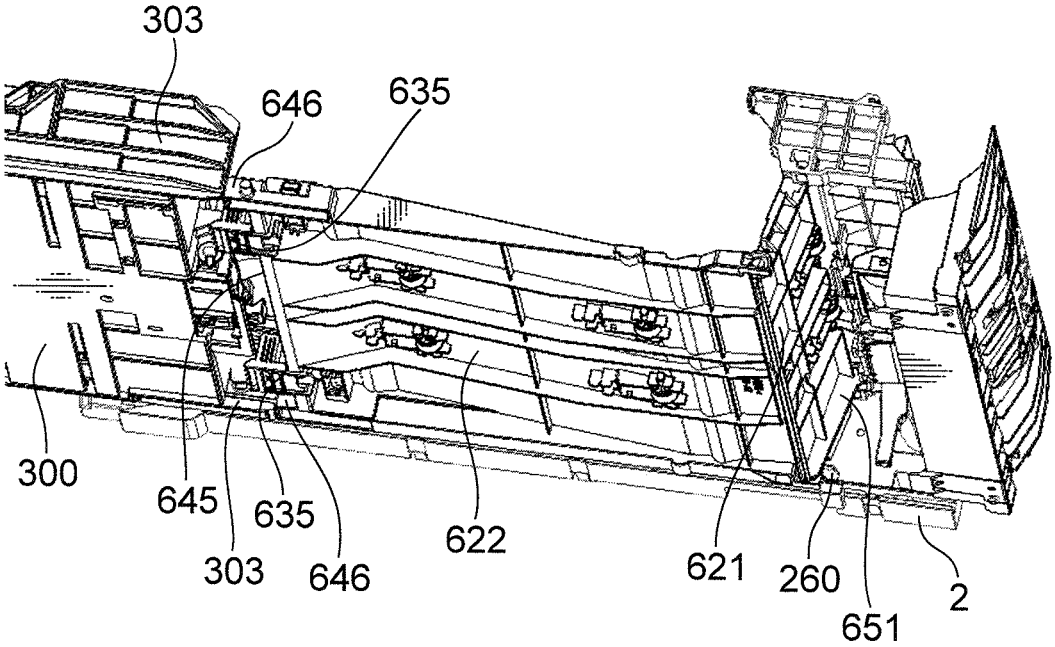
FIG. 10 is a perspective view showing an internal structure of a housing into which a user inserts a cassette, while the displacement element is translated away from a first conveying element.
Figure 11:
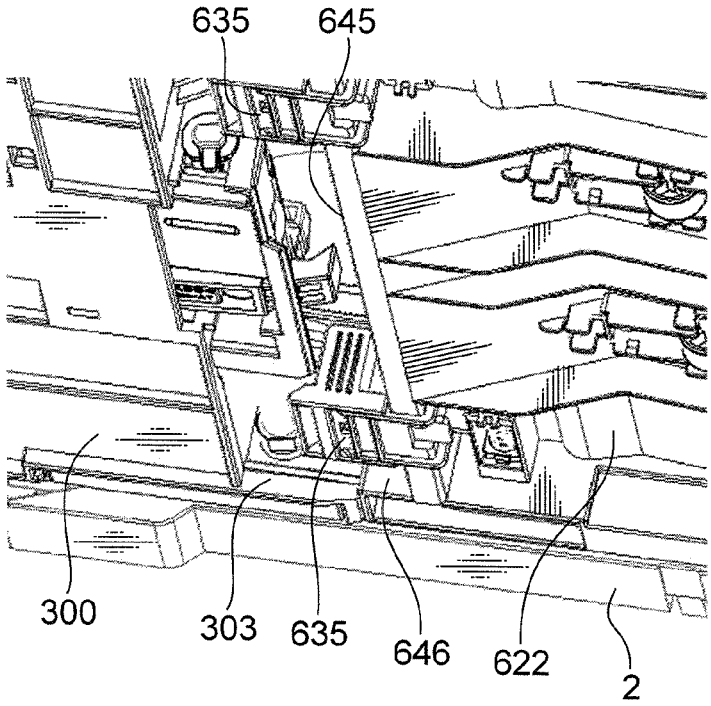
FIG. 11 is an enlarged perspective view of a collision section between the cassette and displacement element shown in FIG. 10.

FIG. 10 is a perspective view showing an internal structure of the housing 2 into which a user inserts the cassette 300 when the displacement element 622 is separated from the first conveying element 610. FIG. 11 is an enlarged perspective view of a collision section between the cassette 300 and displacement element 622 shown in FIG. 10. The structure of the displacement element 622 is described with reference to FIGS. 2, 6A, 6B, 8, 10, and 11.

The displacement element 622 includes a confronting surface 645. The confronting surface 645 confronts the cassette 300 inserted into the housing 2, while the guide piece 643 is in engagement with the first rail 641. The confronting surface 645 includes a protrusion 646 configured to protrude toward the cassette 300. In the present embodiment, both side walls 303 of the cassette 300 protrudes toward the back wall 24 of the housing 2. Therefore, although the handle 635 protrudes toward the cassette 300 rather than the protrusion 646, the protrusion 646 collides with the cassette 300 first. Thus the handle 635 even in a relatively complicated shape is less likely to be damaged by the collision between the cassette 300 and the displacement element 622.

Figure 12:
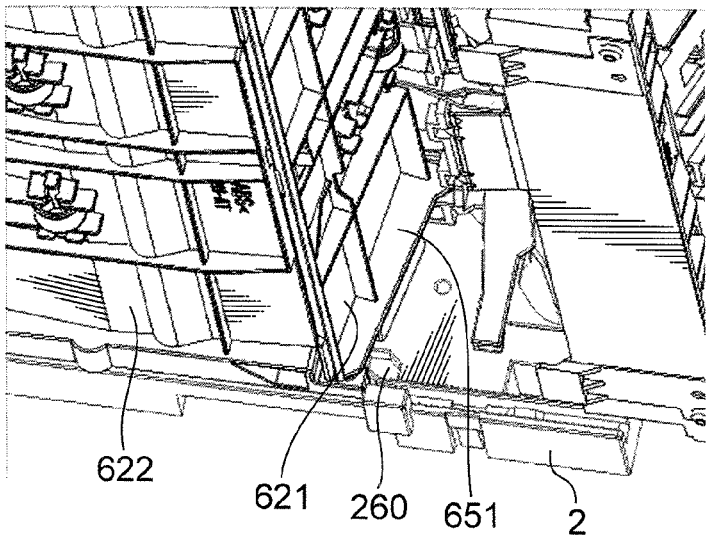
FIG. 12 is an enlarged perspective view of a contact piece configured to prevent a turning element from unnecessarily turning due to a collision with the cassette.

FIG. 12 is an enlarged perspective view of a contact piece configured to prevent the turning element 621 from unnecessarily turning due to the collision with the cassette 300. The contact piece is described with reference to FIGS. 2 to 4, FIG. 10, and FIG. 12.

Instead of and/or in addition to the neck 644 of the above-mentioned rail 640, the housing 2 may comprise a contact piece 260 protruding from an inner surface of the housing 2. As described in the context of FIGS. 3 and 4, the pivotal first end 623 of the turning element 621 is connected to the inner surface of the housing 2. As shown in FIG. 10, when the cassette 300 collides with the displacement element 622, the turning element 621 is likely to further turn to the back wall 24 of the housing 2.

Ribs are formed on a surface of the turning element 621, which is on the opposite side of a surface confronting the first conveying element 610. A rib 651 formed along a side edge of the turning element 621 is the highest among these ribs. The contact piece 260 is formed near a lower edge of an inner surface of the housing 2. Because the rib 651 comes into contact with the contact piece 260, the turning element 621 which turns toward the back wall 24 of the housing 2 is stopped.

Figure 13:
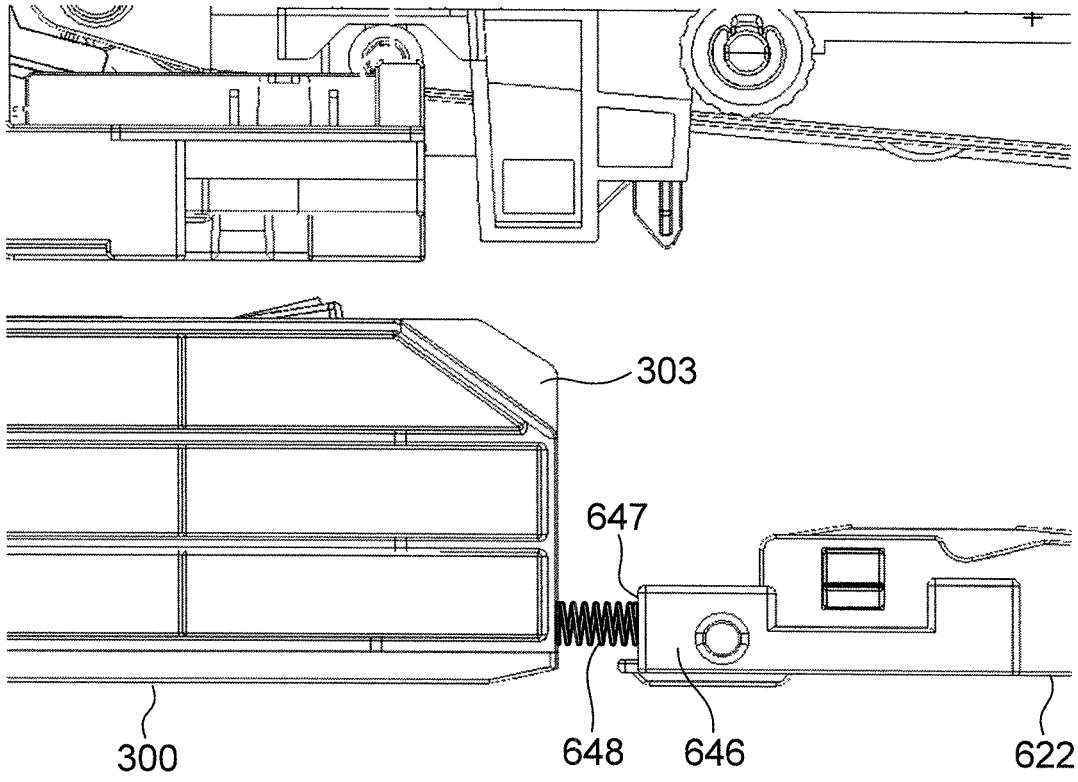
FIG. 13 is a diagram schematically showing an improved protrusion of the displacement element.

FIG. 13 schematically shows an improved protrusion 646 of the displacement element 622. The improved protrusion 646 is described with reference to FIG. 13.

A cushion 648 may be attached to a colliding surface 647 of the protrusion 646 to be collided with the side wall 303 of the cassette 300. The cushion 648 shown in FIG. 13 is a coil spring. Alternatively, any member that has a shock mitigation/absorption function for mitigating the shock of the collision between the protrusion 646 and the cassette 300 may be used as the cushion 648. Since the cushion 648 mitigates/absorbs the shock between the protrusion 646 and the cassette 300, the displacement element 622 and/or the turning element 621 is less likely to be damaged.

Figure 14:
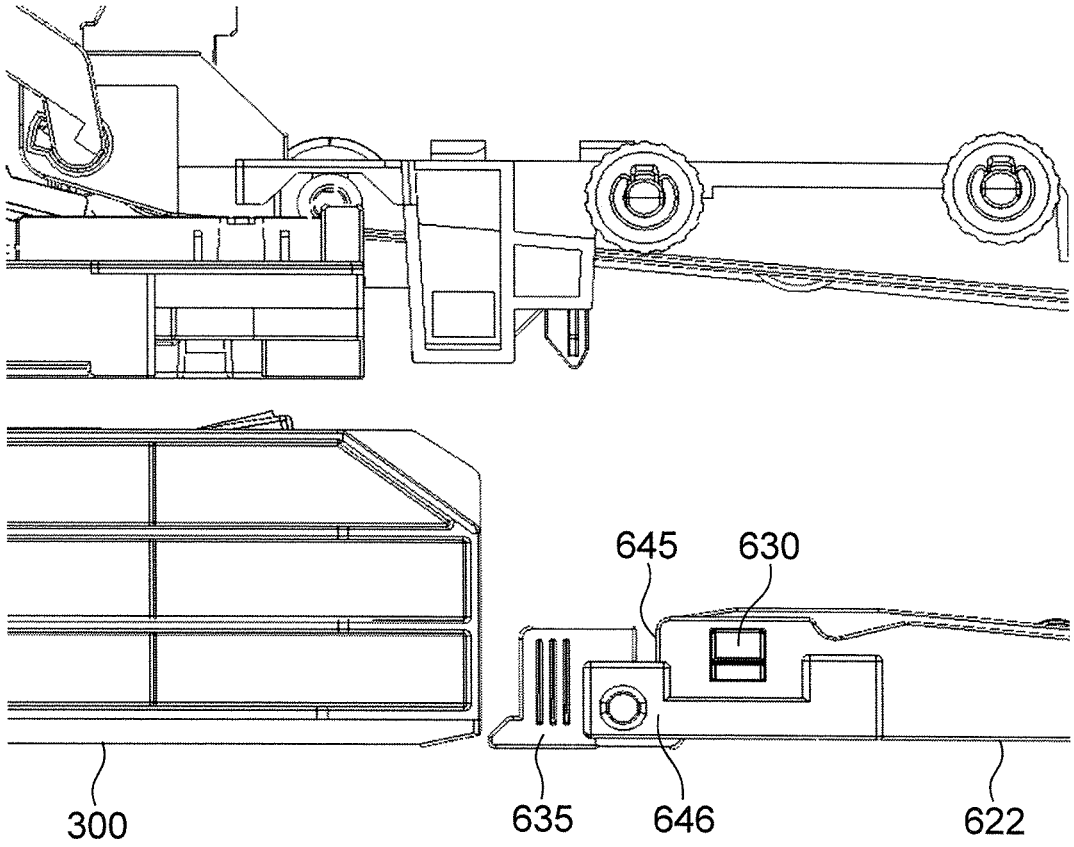
FIG. 14 is a diagram showing a handle colliding with the cassette.
Figure 15:
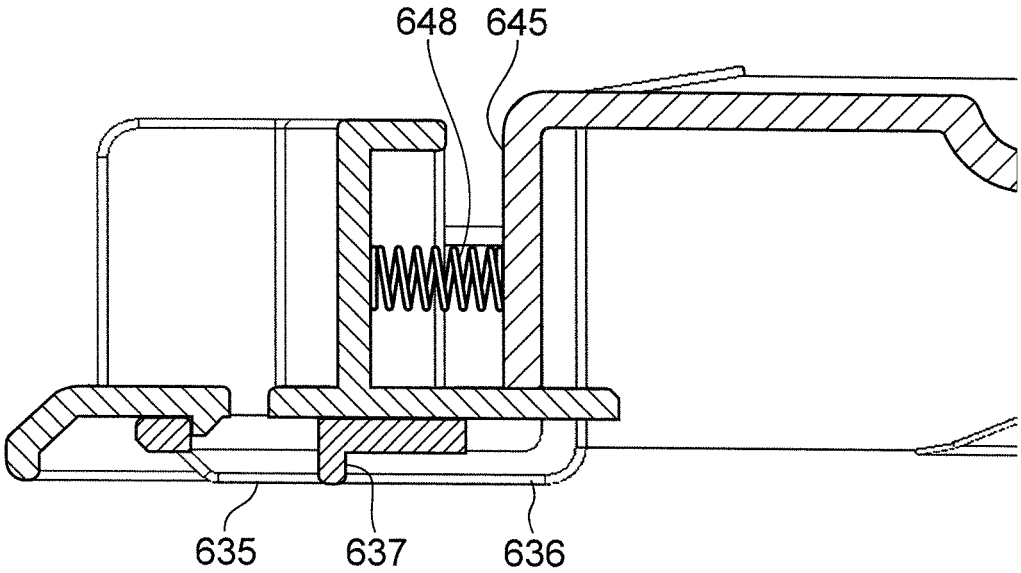
FIG. 15 is a cross-sectional diagram schematically showing the handle depicted in FIG. 14.

FIG. 14 shows the handle 635 to be collided with the cassette 300. FIG. 15 is a cross-sectional view schematically showing the handle 635 shown in FIG. 14. An improved handle 635 is described with reference to FIGS. 5 to 6B, FIG. 11, and FIGS. 13 to 15.

As described in the context of FIGS. 6A and 6B, a user applies downward force to the handle 635 to disable the positioning function of the positioning mechanism 630 configured to position the displacement element 622 in the first position. The handle 635 consequently protrudes toward the cassette 300. In the collision between the cassette 300 and the displacement element 622 that is described in the context of FIG. 11, the protrusion 646 collides with the side wall 303 of the cassette 300 first. Alternatively, if the cassette 300 is in a specific shape, the handle 635 may collide with the cassette 300 first.

When the handle 635 collides with the cassette 300, the handle 635 may be connected to the displacement element 622 so that the handle preferably separate from or approach the confronting surface 645. For example, the handle 635 may be guided to separate from or approach the confronting surface 645 by using a slotted hole formed in a substantially L-shaped supporting member 636 configured to support the handle 635 provided in the displacement element 622, as well as the guide piece 637 protruding from a lower surface of the handle 635. The cushion 648 described in the context of FIG. 13 is disposed between the handle 635 and the confronting surface 645. When the cassette 300 collides with the handle 635, the handle 635 approaches the confronting surface 645 to compress an elastic member used as the cushion 648. Consequently the collision between the handle 635 and the cassette 300 is mitigated and/or absorbed, so that the handle 635 is less likely to be damaged. When the cassette 300 separates from the handle 635, the cushion 648 is restored, so that the handle 635 moves away from the confronting surface 645 to return to its original position.

The embodiment described above creates a sufficiently wide space between the first conveying element 610 and the second conveying element 620 in order to remove the sheets. No complicated link mechanism may be interposed between the first conveying element 610 and the second conveying element 620, which results in a smaller image forming apparatus. In addition, since the feeding assembly 520 is not unnecessarily moved, sheet feed settings are less likely to be changed, so that failures in feeding sheets are less likely to occur after removal of sheets, which results in efficient sheet removal.

This application is based on Japanese Patent application serial Nos. 2010-015166 and 2010-059267 filed in Japan Patent Office on Jan. 27, 2010 and Mar. 16, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A conveying mechanism for conveying a sheet, comprising:

a first conveying element including an upstream end on which a feeding assembly for feeding the sheet is formed;

a second conveying element configured to confront the first conveying element;

the second conveying element at least partially defining a conveying path for guiding the sheet in cooperation with the first conveying element has a turning element including a first end and a second end which are aligned along a sheet feeding direction, and a displacement element coupled to the turning element, a positioning mechanism configured to position the displacement element with respect to the first conveying element when the turning element is located in the first position, wherein the first end is held pivotally near the first conveying element, the second end is coupled pivotally to the displacement element, the displacement element extends along the first conveying element and defines the conveying path between the displacement element and the first conveying element when the turning element is located in a first position where the turning element extends along the first conveying element, and the displacement element translates away from the first conveying element to form a corner with the turning element when the turning element turns from the first position to a second position where the second end of the turning element moves away from the first conveying element, wherein the positioning mechanism includes:

(i) an engaging hole defined in the first conveying element, (ii) a retractable engaging piece attached to the displacement element and configured to engage with the engaging hole, and (iii) a biasing member configured to bias the engaging piece so as to protrude the engaging piece with respect to the displacement element.

2. An image forming apparatus with an image forming portion for forming an image on at least one sheet comprising:

a housing configured to accommodate the image forming portion; and a conveying mechanism configured to at least partially define a conveying path for guiding the sheet to the image forming portion, wherein the conveying mechanism has a first conveying element including an upstream end on which a feeding assembly for feeding the sheet is formed, and a second conveying element configured to confront the first conveying element, the second conveying element configured to define the conveying path in cooperation with the first conveying element, the second conveying element having a turning element including a first end and a second end which are aligned along a sheet feeding direction, and a displacement element coupled to the turning element, the first end is held pivotally near the first conveying element, the second end is coupled pivotally to the displacement element, the displacement element extends substantially parallel to the first conveying element and defines the conveying path between the displacement element and the first conveying element when the turning element is located in a first position where the turning element extends substantially parallel to the first conveying element, the displacement element translates away from the first conveying element to form a corner with the turning element, when the turning element turns from the first position to a second position where the second end of the turning element moves away from the first conveying element the turning element is pivotally supported by the housing, and the housing includes a contact piece configured to come into contact with the turning element and stop turn of the turning element in the second position.

3. The image forming apparatus according to claim 2 wherein the displacement element extends substantially horizontally at the first position.

4. The image forming apparatus according to claim 2 wherein the corner formed by the displacement element and the turning element when the displacement element translates away from the first conveying element has an angle of greater than 180° facing away from the first conveying element.

5. An image forming apparatus with an image forming portion for forming an image on at least one sheet, comprising:

a housing configured to accommodate the image forming portion; and a conveying mechanism configured to at least partially define a conveying path for guiding the sheet to the image forming portion, wherein the conveying mechanism has a first conveying element including an upstream end on which a feeding assembly for feeding the sheet is formed, and a second conveying element configured to confront the first conveying element, the second conveying element configured to define the conveying path in cooperation with the first conveying element has a turning element including a first end and a second end which are aligned along a sheet feeding direction, and a displacement element coupled to the turning element, the first end is held pivotally near the first conveying element, the second end is coupled pivotally to the displacement element, the displacement element extends along the first conveying element and defines the conveying path between the displacement element and the first conveying element when the turning element is located in a first position where the turning element extends along the first conveying element, and the displacement element translates away from the first conveying element to form a corner with the turning element, when the turning element turns from the first position to a second position where the second end of the turning element moves away from the first conveying element the housing includes a first rail configured to guide insertion and drawing out of a cassette, and a second rail configured to guide displacement of the displacement element in a direction where the displacement element translates away from the first conveying element, the second rail is joined together with the first rail, and the displacement element includes a guide piece configured to move along the first rail and the second rail.

6. The image forming apparatus according to claim 5 wherein the first rail includes a neck configured to stop the guide piece moving along the first rail from a junction between the first rail and the second rail.

7. The image forming apparatus according to claim 5 wherein the second rail is configured so that the displacement element translates away from the first conveying element after the cassette is removed from the housing.

8. The image forming apparatus according to claim 7 wherein the displacement element includes a confronting surface configured to confront the cassette inserted into the housing while the guide piece is engaged with the first rail, and the confronting surface includes a protrusion protruding to a position to collide with the cassette first when the cassette is inserted into the housing while the guide piece is engaged with the first rail.

9. The image forming apparatus according to claim 8 wherein the protrusion includes a cushion configured to moderate the collision between the protrusion and the cassette.

10. The image forming apparatus according to claim 9 wherein the protrusion includes a handle configured to transmit force to the displacement element existing in the first position, the handle is connected to the displacement element so as to approach and move away from the confronting surface, and the cushion includes an elastic member between the handle and the confronting surface.

11. The image forming apparatus according to claim 5 wherein the at least one sheet includes a first sheet fed by the feeding assembly and a second sheet fed from the cassette to the image forming portion.

12. The image forming apparatus according to claim 5 wherein the displacement element extends substantially horizontally at the first position.

13. The image forming apparatus according to claim 5 wherein the corner formed by the displacement element and the turning element when the displacement element translates away from the first conveying element has an angle of greater than 180° facing away from the first conveying element.

* * * * *